US005979290A

United States Patent [19]

Simeone

[11] Patent Number: 5,979,290

[45] Date of Patent: Nov. 9, 1999

[54] MINE CLEARING DEVICE

[76] Inventor: Salvatore Simeone, 36 Heights Rd., Manhasset, N.Y. 11030

[21] Appl. No.: 09/118,842

[22] Filed: Jul. 20, 1998

[51] Int. Cl.[6] ..... F41H 11/16

[52] U.S. Cl. ..... 89/1.13; 102/403; 86/50

[58] Field of Search ..... 89/1.13, 1.11; 86/50; 102/402, 403

[56] References Cited

U.S. PATENT DOCUMENTS

| | | | |
|---|---|---|---|
| 3,040,658 | 6/1962 | Maltby | 102/18 |
| 3,112,669 | 12/1963 | Damblanc | 89/1 |
| 4,008,644 | 2/1977 | Kayser | 89/1.11 |
| 4,437,382 | 3/1984 | Yerushalmi | 86/50 |
| 4,640,474 | 2/1987 | Manseth | 249/31 |
| 4,695,012 | 9/1987 | Lindenbaum | 244/26 |
| 4,773,617 | 9/1988 | McCampbell | 244/24 |
| 5,096,141 | 3/1992 | Schley | 244/25 |
| 5,240,206 | 8/1993 | Omiya | 244/25 |
| 5,313,868 | 5/1994 | Wolf | 89/1.13 |
| 5,712,441 | 1/1998 | Grunewald | 89/1.13 |

FOREIGN PATENT DOCUMENTS

| | | | |
|---|---|---|---|
| 581668 | 2/1994 | European Pat. Off. | 86/50 |
| 1158411 | 11/1963 | Germany | 89/1.13 |
| 2121089 | 11/1972 | Germany | 89/1.13 |
| 2363557 | 6/1975 | Germany | 89/1.13 |
| 3731191 | 3/1989 | Germany | 89/1.13 |

OTHER PUBLICATIONS

Marsden; Defeat of Tactical Mine Fields, National Defense, vol. LX, No. 332; pp. 127–129.

*Primary Examiner*—Stephen M. Johnson
*Attorney, Agent, or Firm*—Charles E. Temkoe

[57] ABSTRACT

A device for clearing land mines. In a first embodiment, a buoyant air frame (11)supports a rigid plate (13) therebelow, the plate having a side wall adapted to cover a suspected area. The plate includes a pressure catalyst in the form of a shaped charge (44) or compressed air container which, when activated, causes intense enclosed pressure which destabilizes a buried mine (50) sufficient to detonate it without actuating a tripping device. In a second embodiment, a ground based maneuverable vehicle (111) supports a frame (112) which, in turn, supports a plate (113), the frame (112) including shock absorbing components (142–143).

6 Claims, 3 Drawing Sheets

FIG. 2
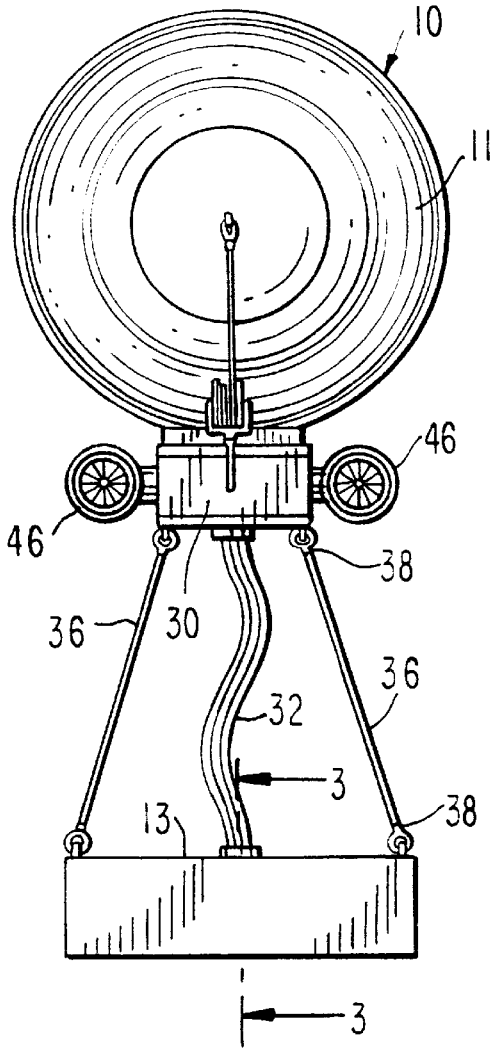
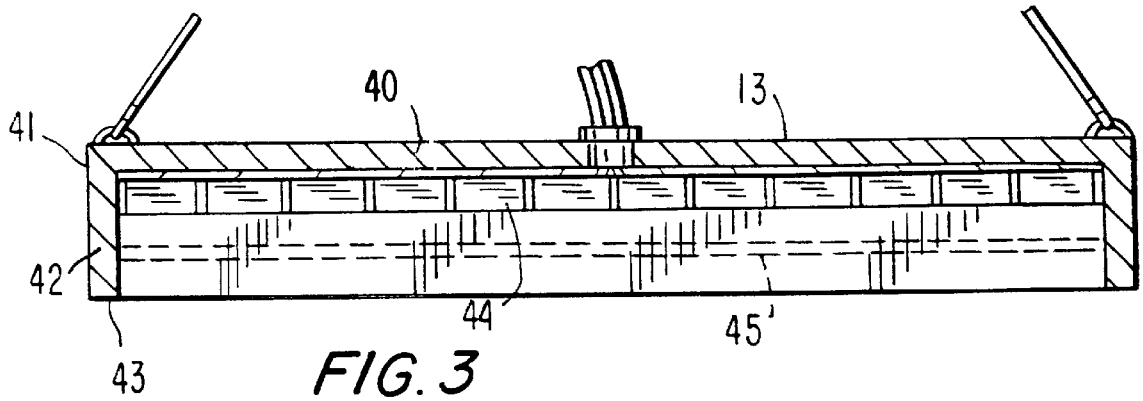
FIG. 3

MINE CLEARING DEVICE

TECHNICAL FIELD

This invention relates generally to the field of mine clearing operations, and more particularly, to an improved vehicle supported device which is maneuvered into position above a suspected area and lowered into operative position where the suspected mine or mines are harmlessly detonated in such manner that fragmentation is confined beneath an overlying peripherally flanged plate.

BACKGROUND ART

It is known in the art to destruct buried mines by detonating an explosive charge adjacent to the mines, rather than attempt to remove it. Such procedure is not without danger, in that the location of the mine must first be determined using known detection means, and the charge must be positioned reasonably close to the location while exercising due care to avoid discharging the mine. In recent years, the use of mines made entirely without metallic components, has made destruction of these mines much more difficult. Such mines are usually of the antipersonnel type, and are extremely cheap to manufacture.

DISCLOSURE OF INVENTION

Briefly stated, the present invention contemplates the provision of an improved vehicle supported device which is maneuvered into position above a suspected area. The device includes a horizontally oriented cover plate element having a flanged rim supported beneath an overlying frame element and containing a shaped explosive charge or equivalent which is discharged after the plate has been positioned in contact with ground. The instantaneous increase in pressure beneath the plate destabilizes a buried mine disposed therebeneath, and causes it to explode without the necessity of actuating any triggering device on the mine. The plate contains most, if not all, of the discharged fragments of the mine, and because of the weight of the plate, most of the imparted energy as well. In one embodiment, the plate is supported by an airborne blimp or balloon in which maneuvering of the device is manually accomplished by tether manipulation. In another embodiment, a ground based wheeled vehicle supports the plate element forwardly thereof.

BRIEF DESCRIPTION OF THE DRAWINGS

The details of my invention will be described in connection with the accompanying drawings, in which

FIG. 2 is a top plan view thereof;

FIG. 3 is a vertical sectional view as seen from the plane 3—3 in FIG. 2;

BEST MODE FOR CARRYING OUT THE INVENTION

Figure 1:
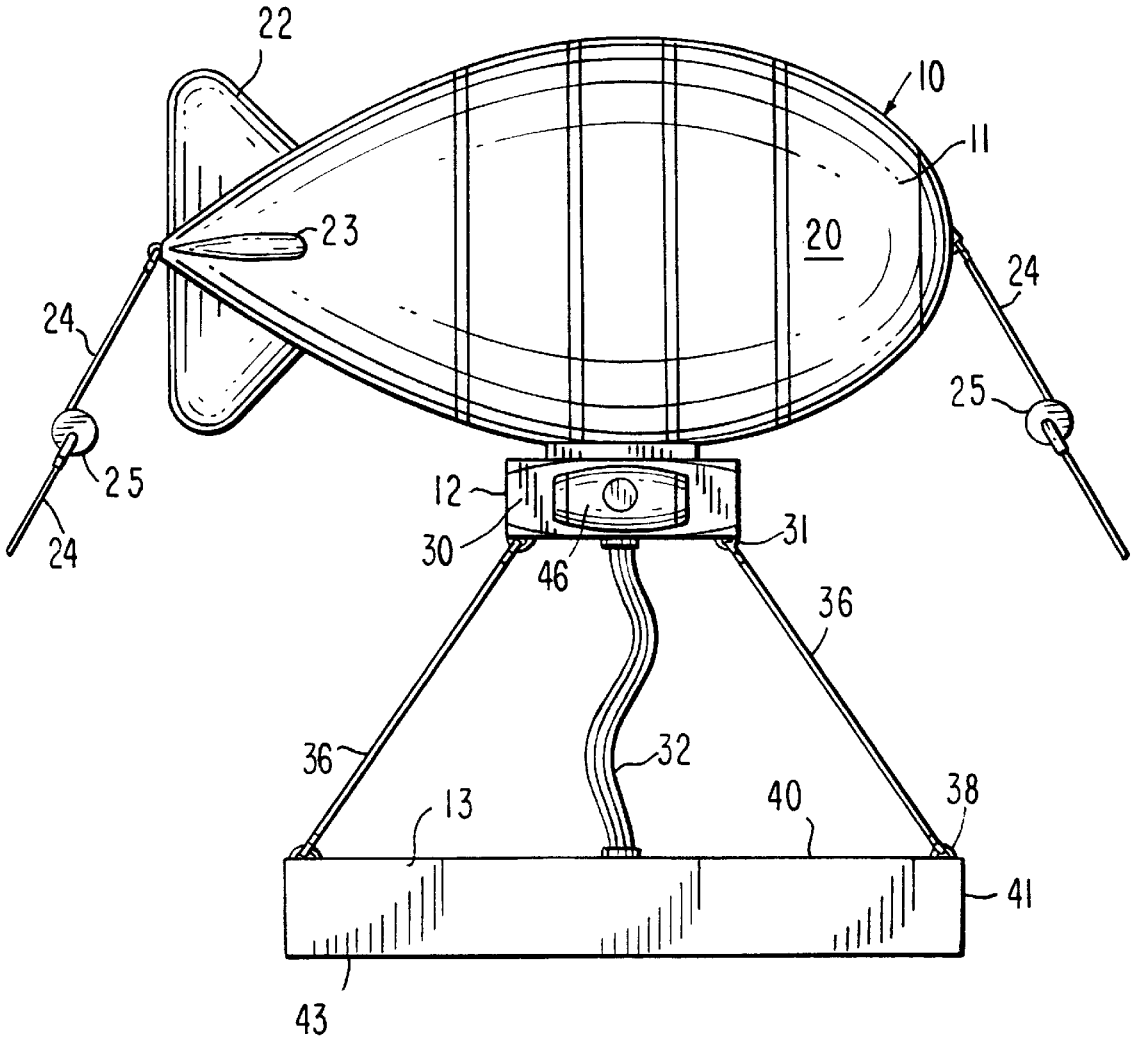
FIG. 1 is a side elevational view of a first embodiment.

In accordance with the first embodiment of the invention, the device, generally indicated by reference character 10, comprises broadly, a buoyant element 11, a control element 12, and a horizontal plate element 13.

The buoyant element 11 is preferably in the form of a small blimp having a semi-rigid body 20 filled with helium or other lighter-than-air gas, and may include horizontal and vertical fins 22 and 23, respectively, for stability in the presence of strong winds. The body 20 is positioned by the use of one or more tether cables 24, the free ends of which are wound about energy-absorbing spools 25. Normally, the device will require positioning of the body 20 by movement of the free end of the cables by personnel positioned at a safe distance.

The control element 12 is supported at the underside of the buoyant element 11, and includes a shock resistant housing 30 enclosing a known radio receiver (not shown) for receiving activating signals which are transmitted to the plate element 13. In the alternative, a signal may be transmitted along one of the tether cables, thereby eliminating the need for the receiver. In either event signals are transmitted by cables 32 to the plate element 13. Four flexible cables 36 interconnect the plate element to the control element, each including an upper end 37 and a lower end 38.

The plate element 13 may be of either circular or rectangular configuration, and of a size sufficient to cover a substantial portion of a suspected area. It may be formed of a variety of materials, but most conveniently, of cast iron or steel in order to have sufficient weight to absorb energy developed when a mine explodes. It includes a horizontal wall 40 having a curvilinear or rectilinear periphery 41 which communicates with a flanged side wall 42 having a lower free edge 43 to define a cavity enclosing one or more shaped charges 44 or an equivalent compressed air device (not shown). An optional malleable plate 45 is also positioned with the cavity to serve to evenly distribute pressure generated by discharge of a shaped charge. Also optional, are a pair of ducted fans 46 controlled from the control unit 12 which can rotate and act independently to give maneuvering thrust.

Figure 4:
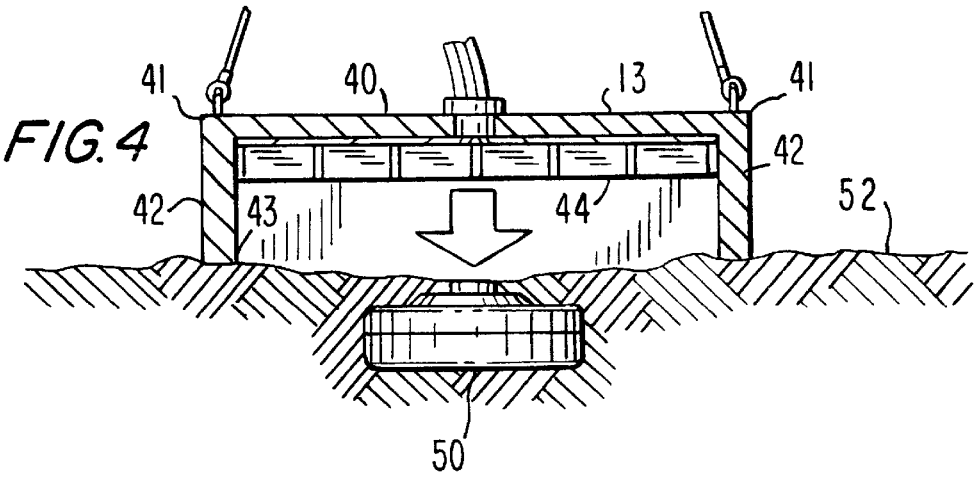
FIG. 4 is a schematic view showing a plate element comprising the device in ground-engaging position.
Figure 5:
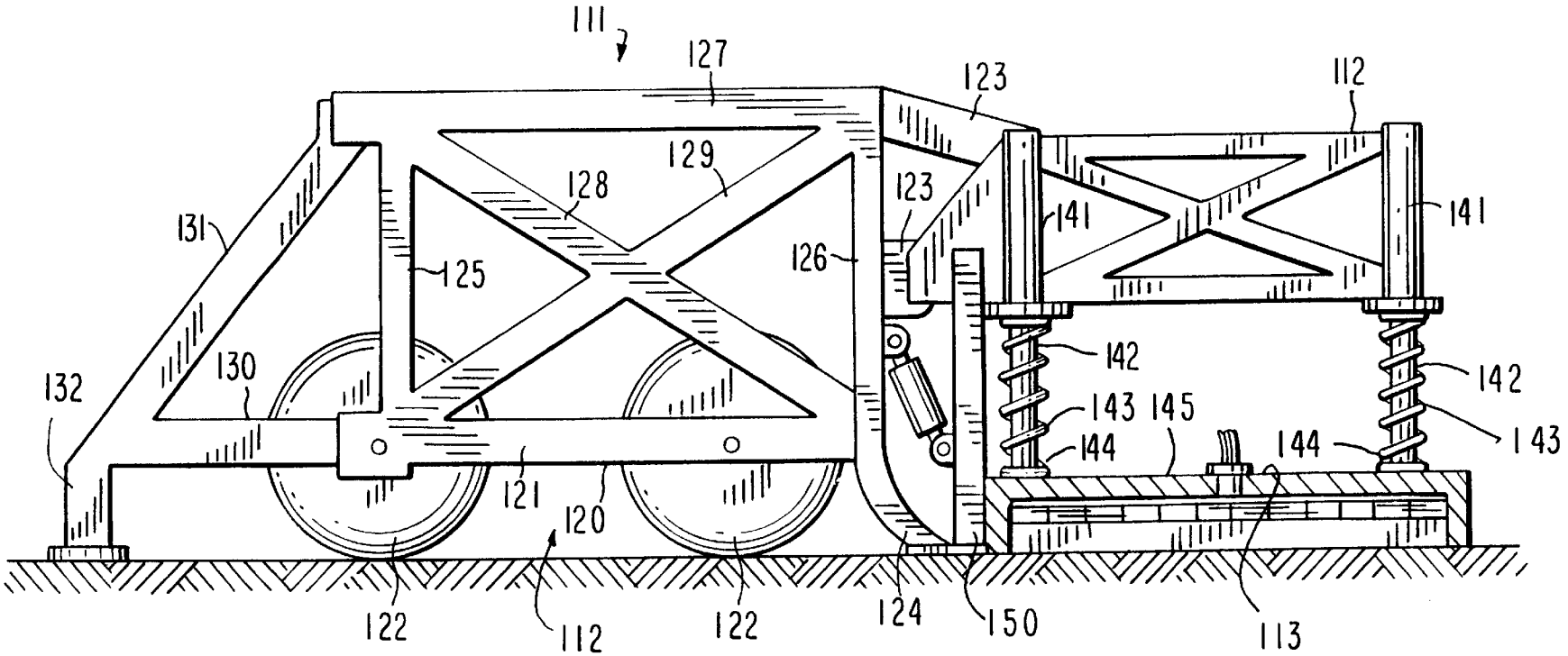
FIG. 5 is a schematic side elevational view of a second embodiment of the invention.

Referring to FIG. 4, the device is shown in position for operation, in which the edge 43 is placed in direct contact with the surface 52 of a suspected area in which a mine 50 has been planted. One of the shaped charges 44 is then fired, resulting in the creation of sufficient pressure to destabilize the mine and cause it to explode. Upon explosion of the mine, the plate element will entrap most, if not all, of the fragmentation before the generated force causes the plate element to move upwardly, at which time the remaining pressure is relieved to the surrounding area without causing damage. Once the plate element moves upwardly, the weight supported by the buoyant element 11 is temporarily relieved, causing the element 11 to rise. At this point, the tether cables 24 transmit this force to the spools 25 which will at least partially absorb some of the transmitted energy without damage to the tether cables or the buoyant element.

Following the above operation, the entire device may be guided to an adjacent suspected area and the process repeated.

Turning now to the second embodiment of the invention, illustrated in FIG. 4, this embodiment differs from the first embodiment in that the buoyant means is replaced by a maneuverable vehicle element 111 which mounts a forwardly extending frame element 112 which in turn supports a horizontal plate element 113 therebeneath.

The vehicle element 111 comprises a rigid metal chassis 112 including lower horizontal members 121 mounting supporting wheels 122 and having a forwardly extending support 123 which supports the frame element 112. Because of the proximity of the vehicle element to the plate element 113, the chassis 120 includes a blast shield 124 which extends close to ground level. To provide adequate rigidity, the chassis 120 also includes vertical members 125 and 126, horizontal trust members 127 and cross members 128 and 129. A rearwardly extending part 130 of members 120 includes an angularly disposed support member 131 which, together with members 130 mounts a ground-engaging member 132 which brakes any horizontally oriented force generated during detonation.

The frame element 112 is of rectangular configuration, and constructed in the manner of the chassis 120. It includes four hollow shafts 141, two of which are illustrated, each enclosing a telescoping shock absorber 142 and surrounding coil spring 143 which are similar to front end suspension components used in the automotive industry. The lower end 144 of each spring 143 is connected to the upper surface 145 of the plate element 113.

The plate element 113 is generally similar to that of the first embodiment, and includes a vertical strut 150 mounting separate shock absorbers 151, the upper ends of which are interconnected to the chassis 120 in a manner to absorb not only vertical but horizontal components of the blast force.

Operation of the device may be entirely manual, in which case the chassis element is not motorized but pushed into operative condition. During this maneuvering, the plate element and ground engaging member 132 may be manually retracted by means (not shown) until exact positioning is accomplished, following which the plate element and ground engaging member are adjustably positioned to engage the ground surface. The shaped charge is then detonated as in the first embodiment. With detonation, the plate element will absorb, by virtue of its own inertia, substantial amount of the energy developed, and the remaining energy will be absorbed by the shock absorbers 142 and coil springs 143, as well as the shock absorber 151. Normally, this action will be adequate, but in the event that the force is so great that the chassis 120 is lifted, the ground-engaging member 132 will prevent any substantial horizontal movement.

At the conclusion of detonation, the entire device may be moved forwardly along a pre-determined path to the next suspect area, which may be immediately adjacent, and the process repeated.

It may thus be seen that I have invented novel and highly useful improvements in mine clearing devices which offer many advantages over the prior art. Since in each embodiment, the device is manually maneuvered, there is no fuel cost involved. The entire device may be constructed at relatively low cost, and damaged parts may be readily replaced without difficulty. The plate element may be easily substituted by another having greater or lesser weight and/or diameter, depending upon the particular task involved. Likewise, should the plate element be damaged, it can be conveniently replaced with a similar one. The position of the plate during operation protects the relatively delicate and more expensive components disposed thereabove.

I claim:

1. A device for clearing land mines from a suspected ground area comprising: a maneuverable vehicle, a generally horizontally oriented plate element supported by said vehicle, said plate element including a planar wall and a continuous peripheral flanged side wall defining an open-ended cavity therebetween; detonating means for creating high pressure within said cavity when said plate is placed in contact with said suspected area; said pressure being sufficient to destabilize a mine positioned in said suspected area, and detonate the same.

2. A device in accordance with claim 1, in which said vehicle is an airborne, lighter-than-air aircraft.

3. A device in accordance with claim 1, in which said vehicle is a land based wheeled chassis.

4. A device in accordance with claim 1, including energy absorbing means interconnecting said plate and said vehicle.

5. A device in accordance with claim 3 in which said chassis includes a blast shield at an end thereof adjacent said plate.

6. A device in accordance with claim 5, in which said chassis includes means at an opposite end thereof engagable with an adjacent ground area to maintain said chassis in predetermined position during detonation of a mine.

* * * * *